United States Patent [19]

Krieger

[11] Patent Number: 4,907,560

[45] Date of Patent: Mar. 13, 1990

[54] EXHAUST-GAS RECIRCULATING SYSTEM FOR INTERNAL-COMBUSTION ENGINES

[75] Inventor: Klaus Krieger, Affalterbach, Fed. Rep. of Germany

[73] Assignee: Robert Bosch GmbH, Stuttgart, Fed. Rep. of Germany

[21] Appl. No.: 270,530

[22] Filed: Nov. 14, 1988

[30] Foreign Application Priority Data

Dec. 3, 1987 [DE] Fed. Rep. of Germany ..... 3740968

[51] Int. Cl.[4] ..... F02M 25/06; F02D 21/08; F02D 1/18

[52] U.S. Cl. ..... 123/569

[58] Field of Search ..... 123/568, 569, 571

[56] References Cited

U.S. PATENT DOCUMENTS

| | | | |
|---|---|---|---|
| 4,143,631 | 3/1979 | Stumpp | 123/569 |
| 4,286,567 | 9/1981 | Ueda | 123/569 |
| 4,364,369 | 12/1982 | Nomura et al. | 123/569 |
| 4,373,496 | 2/1983 | Greiner et al. | 123/569 |
| 4,495,929 | 1/1985 | Maeda et al. | 123/569 |
| 4,548,184 | 10/1985 | Laufer et al. | 123/569 |
| 4,718,385 | 1/1988 | Konrath | 123/569 X |

FOREIGN PATENT DOCUMENTS

| | | | |
|---|---|---|---|
| 2658052 | 7/1978 | Fed. Rep. of Germany | 123/569 |
| 2946557 | 5/1981 | Fed. Rep. of Germany . | |

*Primary Examiner*—Willis R. Wolfe
*Attorney, Agent, or Firm*—Felfe & Lynch

[57] ABSTRACT

An exhaust-gas recirculating system for internal-combustion engines includes a fuel-injection system which generates a hydraulic back pressure during control of the load- and speed-dependent variation of the beginning of delivery within a given set of load and speed characteristics. An hydraulic back pressure is used directly to control a pneumatic directional valve by means of an hydraulic servomotor. This directional valve, in turn, controls a vacuum-operated exhaust-gas recirculation valve. The hydraulic back pressure is also controlled by means of a pressure-holding valve and a constricting throttle.

7 Claims, 1 Drawing Sheet

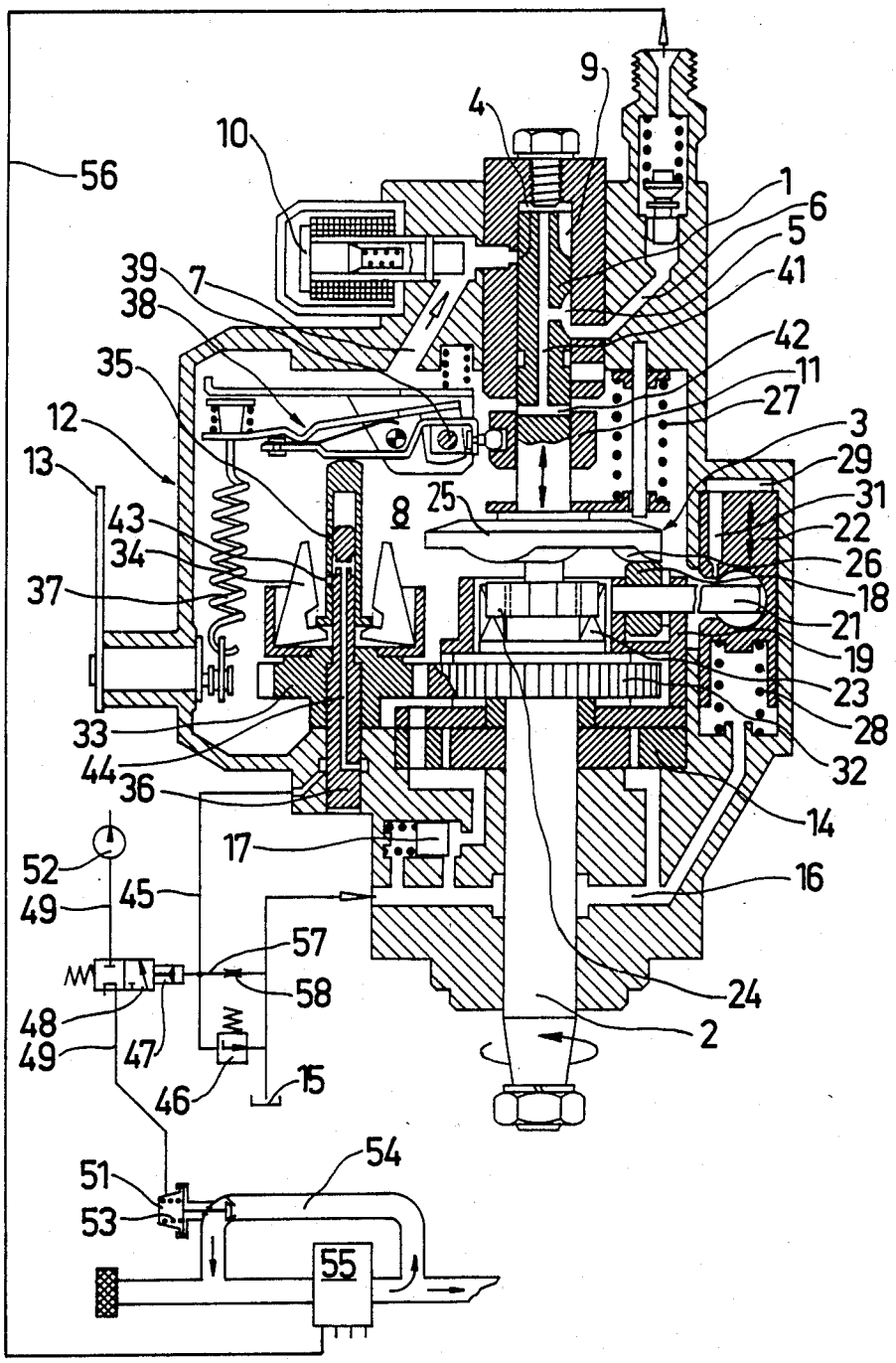
56
10
4
9
1
6
5
41
39
7
38
42
35
11
27
12
3
13
29
31
25
8
22
43
34
26
37
18
21
19
23
33
28
44
36
32
14
52
17
16
49
45
57
58
24
48
2
49
47
46
15
51
54
53
55

EXHAUST-GAS RECIRCULATING SYSTEM FOR INTERNAL-COMBUSTION ENGINES

BACKGROUND OF THE INVENTION

The invention is based on an exhaust-gas recirculating system for an internal-combustion engine.

As is known, the noxious emissions of an internal combustion engine can only be reduced to a certain point by optimization of the combustion chamber and of the fuel injection system. Hydrocarbon (HC) emissions are minimized by advancing the beginning of injection, which increases $NO_x$ emissions. For the reduction of $NO_x$ emissions, it is well known to employ exhaust-gas recirculation (EGR), for which various methods have been developed. This advancing of the beginning of injection, effected specifically to minimize HC emissions, is partly overlapped by the load and speed-dependent regulation of the beginning of injection, for which provision has already been made in the fuel-injection system. As is known, the beginning of injection has to be advanced as the speed increases, particularly in order to compensate for the natural retardation of the injection with increasing speed, which is due to the angularly increasing propagation time of the pressure waves in the fuel injection line. Exhaust-gas recirculation must only be effected below a certain load—that is, below a certain injection quantity—which changes with the speed approximately according to the characteristic load curves of the governor.

A prior art exhaust-gas recirculating system for internal-combustion engines of this type is known from the published German patent application OS 29 46 557.4. In this system a distributor-type pump is used as a fuel injection pump in which delivery is initiated by means of a speed-dependent hydraulic pressure prevailing in the suction chamber of the pump and wherein that pressure is influenced by a discharge opening that is dependent on the position of the sleeve of the centrifugal governor. The position of the governor sleeve is a function of speed and load since the governor sleeve is subject to both the strictly speed-dependent centrifugal forces and, in the opposite direction, the forces which correspond to the load, applied through a governor spring and variable at will by means of the control lever. The discharge port is uncovered by the governor sleeve when the load and speed desired for exhaust gas recirculation are reached. The fuel draining through the discharge port is constricted by means of a throttle, with the back pressure then acting on a pressure-sensitive switch in an electric line of the solenoid of the directional control valve. Moreover, a switch inserted in that line is actuated by a trip cam on the control lever for a specific load range. When both switches are closed, the directional valve shifts so that the pneumatically actuated exhaust-gas recirculation valve is opened. The system thus provides an on/off control of exhaust-gas recirculation rather than a continuous control.

Since it uses a hydraulic pressure switch and a camoperated switch, this type of control is very costly, and also disadvantageous because of the space it requires, as well as being prone to malfunction, quite apart from the fact that the constricting throttle has a specific cross-sectional area which, from a given volume of outflow on, produces the necessary switching pressure. However, with larger volumes being discharged per unit time—that is, with high speeds and with the discharge port opened—this results in the throttle acting as a closure so that the variation of the pressure gradient in the intake chamber intended for adjustment of the beginning of injection does not produce the desired result.

SUMMARY OF THE INVENTION

It is an object of the present invention to provide an exhaust gas recirculating system which is less expensive, and more trouble-free than the prior known system described above.

This object, as well as other objects which will become apparent from the discussion that follows, are achieved, according to the present invention, by providing an exhaust gas recirculating system which includes an exhaust gas recirculating valve in an exhaust gas recirculating line for controlling the passage of gas in the recirculating line in response to a control medium. A directional valve, provided with and actuated by a servomotor, supplies the control medium to the recirculating valve. The fuel injection system for supplying fuel to the internal combustion engine provides a hydraulic pressure for a range of engine characteristics including a minimum load and a minimum speed. The servomotor of the directional valve is hydraulically actuated by directly applying the hydraulic control pressure o the fuel injection system to the servomotor.

According to a particular, preferred feature of the invention, the hydraulic control pressure is also supplied to a pressure holding valve, arranged in parallel with a constricting throttle. Both the pressure holding valve and the constricting throttle return the pressure medium (e.g. fuel) to a storage tank but maintain the pressure necessary for actuation of the servomotor of the directional valve.

The inventive exhaust-gas recirculating system according to the present invention offers the advantage that the direct use of the hydraulic pressure for actuating the directional valve results both in lower cost and in fewer sources of possible malfunction.

The provision of the pressure holding valve makes it possible to keep the cross-sectional area of the constricting throttle very small since, with the discharge port on the governor sleeve closed, the function of the throttle is now merely to lower the hydraulic pressure at the hydraulic servomotor to the point where the directional valve is able to again close. With fuel being discharged, the pressure holding valve, on the other hand, maintains a pressure just high enough to actuate the servomotor and yet low enough that it has no effect on the pressure in the suction chamber, with the result that the load-dependent control of the beginning of delivery is not adversely affected.

Further advantages and advantageous embodiments of the invention will become apparent from the description which follows, from the accompanying drawing, and from the claims.

BRIEF DESCRIPTION OF THE DRAWING

The single figure shows, in longitudinal section, a distributor-type fuel-injection pump which serves to control an exhaust-gas recirculating system, shown diagrammatically, in accordance with the present invention.

DESCRIPTION OF THE PREFERRED EMBODIMENT

In the distributor-type injection pump, a reciprocating and at the same time rotary motion is imparted to a pumping and distributor plunger 1 by a drive shaft 2 through a cam drive 3. With each delivery stroke of the pumping plunger 1, fuel is fed from a working space 4 of the pump through a longitudinal distributor slot 5 to one of several pressure channels 6 which are arranged at uniform angular distances about the pumping and distributor plunger 1, each leading to a combustion chamber (not shown) of an internal-combustion engine. The working space 4 of the pump is supplied with fuel through a suction channel 7 from a suction chamber 8 that is located in the housing of the injection pump and is filled with fuel, the suction channel 7 being opened during the intake stroke of the pumping and distributor plunger 1 through longitudinal control slots 9 provided in the plunger 1. The number of the control slots 9 corresponds to the number of the pressure channels 6, and hence to the number of the delivery strokes executed during one revolution of the pumping plunger. Located in the suction channel 7 is a solenoid-operated valve 10 which blocks the suction channel 7 to end injection, with the result that during the intake stroke of the pumping plunger 1 no fuel can get into the pump working space 4 from the suction chamber 8.

The quantity of fuel to be injected which is fed into the pressure channel 6 with every stroke is determined by the axial position of a control sleeve 11 disposed about the pumping plunger 1. That axial position is determined by means of a speed governor 12 and a control lever 13 that can be operated at will on the basis of the instantaneous speed and load. (The load may correspond to the position of the accelerator of the motor vehicle, for example.)

The suction chamber 8 is supplied with fuel by a feed pump 14 which is driven by the drive shaft 2 and feeds in fuel from a fuel tank 15 and a suction line 16. The initial pressure of the feed pump 14, and hence the pressure in the suction chamber 8, is controlled by means of a pressure-control valve 17, this pressure increasing with increasing speed in accordance with a desired function. The cam drive 3 and the speed governor 12 are located in the suction chamber 8 and are therefore exposed so this pressure on all sides and lubricated by the fuel.

The cam drive 3, driven by the drive shaft 2, comprises a roller ring 19 which carries rollers 18 and is mounted in the housing for rotational displacement over a prescribed angle, the rollers 18 being mounted in its U-shaped cross section. The roller ring 19 is coupled in a nonrotatable manner through a timing pin 21 to an injection-timing piston 22, shown in the drawing angularly displaced by 90 degrees: in other words, as actually positionable perpendicular to the plane of the drawing. Disposed in the internal bore of the roller ring 19 is a jaw clutch in which jaws 23 at the output end of the drive shaft 2 mesh with jaws 24 at the input end of the pumping and distributor plunger 1 so that the latter is able to execute, independently of the drive shaft 2, a lifting motion during its rotation. Mounted on the pumping plunger 1 is a disk cam 25 which by its face, provided with face lobes 26, rides on the rollers 18, with the number of cam lobes corresponding to the number of the pressure channels 6. The disk cam 25 is forced with its contour onto the rollers 18 by springs 27, of which only one is shown.

The injection-timing piston 22, which is axially displaced tangentially to the roller ring, is loaded in one of the directions in which it can be displaced by a return spring 28 and in the other direction by the pressure of the suction chamber 8 which prevails in a space 29 and is transmitted through a throttling channel 31 provided in the injection-timing piston 22. The direction of displacement of the injection-timing piston is such that when the fuel pressure in the suction chamber 8 rises with increasing speed, the injection-timing piston 22, displaced against the pressure of the return spring 28, turns the roller ring 19 so that the face lobes 26 of the disk cam 25 engage the rollers 18 earlier. As a result the start of the stroke of the pumping plunger 1, and hence the beginning of fuel delivery, are advanced relative to the angular position of the drive shaft 2. Thus, the higher the speed, the earlier the beginning of fuel delivery (beginning of injection).

The speed governor 12 is driven through a gear 32 that sits on the drive shaft 2 and drives a speed sensor 33 with fly-weights 34 that act on a governor sleeve 35 which is mounted for axial displacement on a shaft 36 and which, in turn, is engaged by a speed-lever system 38 that is loaded by a governor spring 37 and is linked to the control sleeve 11 to position it for its stroke. To this end, the speed-lever system 38 is pivotably mounted on a pin 39. The preloading of the governor spring 37 can be varied by means of the control lever 13. If the latter is shifted in the direction of increasing load, the preloading of the governor spring 37 increases so that the control sleeve 11 is displaced farther upwardly, which results in an increase in the quantity of fuel injection due to a concomitant delayed opening of an unloading channel 41 of the pump working space 4 during the delivery stroke of the pumping plunger 1. Unloading of the quantity of fuel still in the pump working space 4 always occurs when, during the delivery stroke of the pumping plunger 1, the ports 42 of the unloading channel 41 are uncovered by the control sleeve 11, with the further fuel delivery of the pumping plunger 1 then going into the suction chamber 8.

To be able to control the beginning of delivery (which as described so far is varied only as a function of speed) also on the basis of the load, there is provided in the governor sleeve 35 a spill port 43 which cooperates with a discharge channel 44 extending in the shaft 36, with the result that, either under given engine load conditions which through the control lever 13, the governor spring 37 and the speed-lever system 38 affect the governor sleeve 35, or under given engine-load conditions which affect the speed in that the governor sleeve 35 is shifted by means of flyweights 34, the pressure in the suction chamber 8 is reduced as the discharge channel 44 is opened by the spill port 43. The beginning of delivery is thus retarded.

This opening of the discharge channel 44 always occurs below a given load. For this reason, the fuel flowing out of this channel is used to control the exhaust-gas recirculation, which should also cut in below a given load. One aim of this retarding of the beginning of injection at low load is to reduce $NO_x$ emissions which, however, results in an increase in HC emissions. $NO_x$ emissions are further reduced by exhaust-gas recirculation. However, this results in a slight increase in the fuel consumption of the internal-combustion engine and in HC emissions and poses the problem of black-smoke generation. For these reasons, exhaust-gas recirculation is effected only below a certain load (fuel quantity injected per stroke).

The discharge channel 44 is connected to the fuel tank 15 through a discharge line 45 in which is inserted a pressure-holding valve 46. Upstream of that valve, a hydraulic servomotor 47 of a pneumatic 3/2-way directional valve 48 is connected to the discharge line 45. The directional valve 48 controls a vacuum line 49 which runs from an exhaust-gas recirculation valve 51 to a vacuum source 52. The exhaust-gas recirculation valve 51, which is loaded by a spring 53 in the closing direction, is inserted in an exhaust-gas recirculating line 54 of an engine 55 which through an injection line 56 is supplied from the pressure channel 6 with fuel that is delivered in the manner described above with appropriate regulation of the quantity and of the beginning of delivery. The discharge line 45 comprises a bypass 57 in which a constricting throttle 58 is inserted.

Exhaust-gas recirculation is effected as follows:

Below a given load at which the spill port 43 opens the discharge channel 44, the fuel which flows out of the suction chamber 8 and into the discharge line 45 is there constricted by means of the throttle 58 until the pressure-holding valve 46 opens as a given pressure is reached and, while maintaining that discharge pressure, allows the fuel to flow to the fuel tank 15. Just before that discharge pressure is reached, the hydraulic servomotor 47 opens the pneumatic directional valve 48 so that the exhaust-gas recirculation valve 51 is opened against the force of the closing spring 53 through the aid of a vacuum from the vacuum source 52 and the vacuum line 49. Exhaust gas is thus able to flow through the exhaust-gas recirculating line 54 from the exhaust-gas side of the engine to the intake side. When the discharge channel 44 is then closed again by the governor sleeve 35 as the required load condition is exceeded, the discharge pressure in the discharge line 45 is again reduced by means of the constricting throttle 58, with the hydraulic servomotor 47 then closing the directional valve 48, and with it the exhaust-gas recirculation valve 51.

There has thus been shown and described a novel exhaust-gas recirculating system for internal-combustion engines which fulfills all the objects and advantages sought therefor. Many changes, modifications, variations and other uses and applications of the subject invention will, however, become apparent to those skilled in the art after considering this specification and the accompanying drawing which discloses the preferred embodiment thereof. All such changes, modifications, variations and other uses and applications which to not depart from the spirit and scope of the invention are deemed to be covered by the invention which is limited only by the claims which follow.

What is claimed is:

1. An exhaust gas recirculating system for an internal combustion engine having an air intake line and an exhaust gas line, said system comprising an exhaust gas recirculating line which connects said exhaust line to said intake line; an exhaust gas recirculating valve for controlling the passage of gas in said recirculating line in response to a control medium; a directional valve, provided with and acuated by a hydraulically actuated servomotor, for supplying said control medium to said recirculating valve; a fuel injection system for supplying fuel to the internal combustion engine, said fuel injection system providing a hydraulic control pressure for a range of engine characteristics including a minimum load and a minimum speed; and means for controlling said servomotor, and thereby said directional valve, in response to said hydraulic control pressure, said means for controlling the servomotor including means for directly applying the hydraulic control pressure to said servomotor.

2. The exhaust gas recirculating system as defined in claim 1, wherein said recirculation valve is a normally closed, vacuum actuated valve; wherein said control medium is air at a pressure produced by a vacuum source; and wherein said directional valve is a pneumatic valve, connected between said vacuum source and said recirculation valve.

3. The exhaust gas recirculating system defined in claim 1, wherein said fuel injection system includes means for speed and load dependent adjustment of the timing of the beginning of fuel delivery, said adjustment means producing said hydraulic control pressure.

4. An exhaust gas recirculating system for an internal combustion engine having an intake line and an exhaust gas line, said recirculating system comprising an exhaust gas recirculating line which connects the exhaust line to the intake line; an exhaust gas recirculation valve, arranged in said recirculating line, for controlling the passage of exhaust gases to said intake line; a fuel injection pump having means for producing a hydraulic pressure that increases with engine speed, means responsive to said hydraulic pressure to vary the timing of the beginning of fuel delivery, and control valve means, responsive to engine load and speed, for discharging a portion of the hydraulic pressure medium in dependence upon a minimum speed and a minimum load; a constricting throttle, connected to said control valve means, for constricting the flow of said hydraulic pressure medium; control means for converting the back pressure between said valve means and said constricting throttle into a mechanical variable for said exhaust gas recirculation valve; and a pressure holding valve, arranged in parallel with said constricting throttle, through which excess hydraulic pressure medium is discharged while a back pressure is maintained.

5. The exhaust gas recirculating system defined in claim 4, wherein said control valve means includes a governor sleeve, which is displaceable by means of flyweights against the force of a governor spring, means for preloading said governor spring as a function of engine load, said governor sleeve allowing said hydraulic pressure medium to be discharged through a spill port into a discharge channel when said sleeve is in a given position.

6. The exhaust gas recirculating system defined in claim 1, wherein the fuel injection system includes a distributor type injection pump, said pump having an injection timing device, a pump drive shaft and a fuel pumping and distributor plunger arranged to be rotationally displaced relative to said pump drive shaft by means of said injection timing device for varying the timing of the beginning of fuel delivery; said injection timing device including a cam drive, located between said drive shaft and said pumping and distributor plunger, a hydraulically actuated injection timing piston, which interacts with said cam drive, and means for moving said injection timing piston in dependence upon engine speed, said moving means including a fuel suction chamber within said injection pump housing and means for supplying fuel from said suction chamber to said injection timing piston such that said piston is subjected to the fuel pressure prevailing in said suction chamber.

7. The exhaust gas recirculating system defined in claim 4, wherein the fuel injection pump is a distributor type injection pump, said pump having an injection timing device, a pump drive shaft and a fuel pumping and distributor plunger arranged to be rotationally displaced relative to said pump drive shaft by means of said injection timing device for varying the timing of the beginning of fuel delivery; said injection timing device including a cam drive, located between said drive shaft and said pumping and distributor plunger, a hydraulically actuated injection timing piston, which interacts with said cam drive, and means for moving said injection timing piston in dependance upon engine speed, said moving means including a fuel suction chamber within said injection pump housing and means for supplying fuel from said suction chamber to said injection timing piston such that said piston is subjected to the fuel pressure prevailing in said suction chamber.

* * * * *